US008851456B2

(12) United States Patent
Kosedag

(10) Patent No.: US 8,851,456 B2
(45) Date of Patent: Oct. 7, 2014

(54) BARBED TAPE WITH SENSOR CONDUCTOR AND REINFORCEMENT WIRE

(75) Inventor: Ali Kosedag, Istanbul (TR)

(73) Assignee: Kosedag Tel Orme Sanayi Ve Ticaret Ithalat Ithracat A.S., Istanbul (TR)

( * ) Notice: Subject to any disclaimer, the term of this patent is extended or adjusted under 35 U.S.C. 154(b) by 36 days.

(21) Appl. No.: 13/320,196

(22) PCT Filed: May 6, 2010

(86) PCT No.: PCT/EP2010/056219

§ 371 (c)(1),
(2), (4) Date: Jan. 10, 2012

(87) PCT Pub. No.: WO2010/130637

PCT Pub. Date: Nov. 18, 2010

(65) Prior Publication Data

US 2012/0126191 A1 May 24, 2012

(30) Foreign Application Priority Data

May 11, 2009 (EP) ..... 09159951

(51) Int. Cl.
*E04F 17/04* (2006.01)
*E04H 17/04* (2006.01)
*B21F 25/00* (2006.01)

(52) U.S. Cl.
CPC ..... *B21F 25/00* (2013.01); *E04H 17/04* (2013.01)
USPC ..... 256/8

(58) Field of Classification Search
USPC ..... 256/2, 5, 6, 7, 8, 9, 10, 52, 54
See application file for complete search history.

(56) References Cited

U.S. PATENT DOCUMENTS

| | | | | | |
|---|---|---|---|---|---|
| 287,059 | A | * | 10/1883 | Scutt | 256/7 |
| 367,398 | A | * | 8/1887 | Hodge | 256/6 |
| 1,039,531 | A | * | 9/1912 | Hartley | 256/54 |
| 2,735,833 | A | * | 2/1956 | Larson | 524/201 |
| 4,509,726 | A | * | 4/1985 | Boggs et al. | 256/8 |
| 4,818,972 | A | * | 4/1989 | Mainiero et al. | 256/8 |
| 4,887,796 | A | * | 12/1989 | Cano et al. | 256/8 |
| 5,401,002 | A | * | 3/1995 | Major | 256/2 |
| 5,555,607 | A | * | 9/1996 | Parveris | 24/129 R |
| 5,784,762 | A | * | 7/1998 | Huntting | 256/54 |
| 6,601,830 | B1 | * | 8/2003 | Pavlov | 256/8 |
| 7,325,787 | B1 | * | 2/2008 | Gibbs | 256/2 |

FOREIGN PATENT DOCUMENTS

GB 2 300 206 A * 10/1996 ..... B21F 25/00

* cited by examiner

*Primary Examiner* — Michael P Ferguson
(74) *Attorney, Agent, or Firm* — Epstein Drangel LLP; Robert L. Epstein

(57) ABSTRACT

The present invention provides a fencing system having interconnected tubular elements comprised of longitudinally extending conductor wires and reinforcement wires. Said conductor wires are conventionally disposed in an outer casing's cavity with an open round or rounded section. Said outer casing is formed by a crimping process such that said conductor wires are reinforced by parallelly extending reinforcement wires, the latter wires being disposed in a separate partition of the longitudinal inner volume of said outer casing. Said partition assigned to said reinforcement wires provides that said reinforcement wires does not damage said conductor wires during the final stage of crimping process in which barbed tapes with pointed and/or cutting barbs are transversely folded around the interconnected tubular elements.

5 Claims, 3 Drawing Sheets

BARBED TAPE WITH SENSOR CONDUCTOR AND REINFORCEMENT WIRE

TECHNICAL FIELD OF THE INVENTION

The present invention relates to a fencing system of the type having signal conducting properties, the system having improved mechanical strength.

BACKGROUND OF THE INVENTION

A plurality of patents/patent applications is present in the present field in relation to fencing systems. One such application is GB 2300206 relating to an element with an outer casing with an open round or rounded section bounding a cavity and made from a strip with punched or cut fins intended to injure intruders, wherein said cavity contains an electrical conductor axially arranged in the cavity and a steel casing, the conductor being insulated from the said casing by an insulating sheath, the element being intended for form spiral coils.

The fencing system of GB 2300206 is disadvantageous in that it fails to provide a system which is resistant enough to be cut to deter intruders. The present invention on the other hand proposes a fencing system having interconnected elements such that each element comprises, additional to a conventional sensor conductor, a reinforcing member imparting substantially increased mechanical strength properties to the overall fencing system. To this end, the present invention features a fencing element designed to incorporate an inner reinforcing wire extending all along the sensor conductor.

Disposing a bulky support wire alongside an electrical and/or optical conductor to be crimped such that an outer casing with an open round or rounded section bounding a cavity enclosing said support wire together with said electrical and/or optical conductor poses manufacturing problems as said reinforcement wire might damage said conductor wire during crimping process. Therefore, the present invention further provides a method for manufacturing a fencing system having interconnected elements comprised of conductor wires and reinforcement wires wherein said wires are crimped in the manner that damage to said conductor wires by said reinforcement wires during crimping is prevented.

The present invention further provides a fencing system with improved mechanical strength also having sharp barbs in the form of conventional barbed tapes provided with pointed and/or cutting barbs and transversely folded around the interconnected tubular elements.

OBJECTS OF THE INVENTION

One of the objects of the present invention is to provide a fencing system having interconnected elements comprised of longitudinally extending conductor wires and reinforcement wires with a substantially increased mechanical strength against cutting so as to deter intruders.

Another object of the present invention is to provide a fencing system having interconnected tubular elements comprised of longitudinally extending conductor wires and reinforcement wires crimped such that damage to said conductor wires by said reinforcement wires during crimping process is prevented.

SUMMARY OF THE INVENTION

The present invention provides a fencing system having interconnected tubular elements comprised of longitudinally extending conductor wires and reinforcement wires. Said conductor wires are conventionally disposed in an outer casing's cavity with an open round or rounded section. Said outer casing is formed by a crimping process such that said conductor wires are reinforced by parallelly extending reinforcement wires, the latter wires being disposed in a separate partition of the longitudinal inner volume of said outer casing. Said partition assigned to said reinforcement wires provides that said reinforcement wires does not damage said conductor wires during the final stage of crimping process in which barbed tapes with pointed and/or cutting barbs are transversely folded around the interconnected tubular elements.

BRIEF DESCRIPTION OF THE FIGURES

Accompanying drawings are given solely for the purpose of exemplifying a barbed tape fence with sensor conductor, whose advantages over prior art were outlined above.

DETAILED DESCRIPTION OF THE INVENTION

Figure 1:
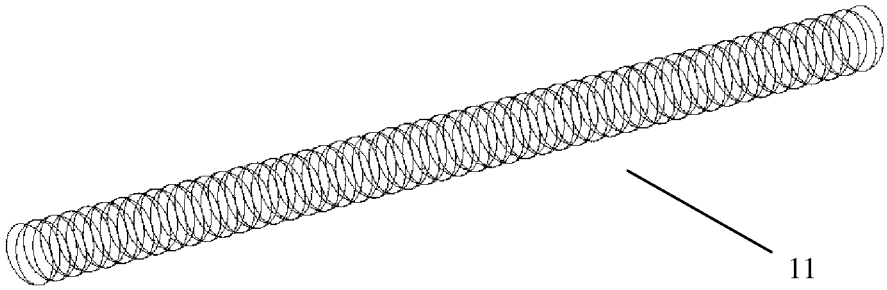
FIG. 1 demonstrates a perspective view of a conventional helical wire adapted to be supported on fence posts.

Referring now to the figures outlined above, the present invention provides a fencing system (11) comprising interconnected fencing elements (12), each element (12) with a reinforcement wire (13) and a conventional sensor wire (14). Electrical conductors insulated by a first layer of insulating material and by a second layer of a vibration sensitive electrical coaxial cable are practiced in the art. A conductor wire (14) according to the present invention may be comprised of conventional optical fibers, connected to a warning system responsive to any breakage and/or variation of conduction capability of said conductors.

Each inter-connected fencing element (12) according to the present invention may be provided with conventional barbed tapes (15). Said fencing elements (12) are provided with an outer casing (16) with an open round or rounded section (17) bounding a cavity (22) enclosing said support wire (13) together with said sensor conductor (14).

Figure 2:
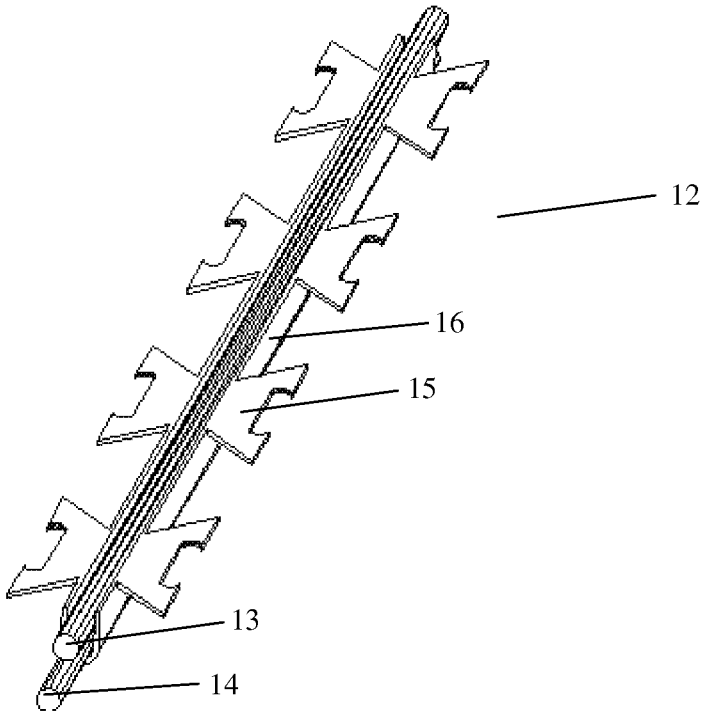
FIG. 2 demonstrates a perspective view of a tubular fencing element having transverse barbed tapes according to the present invention.

The outer casing (16) according to the present invention is provided in the form of a two-cell structure, each cell (18, 20) enclosing reinforcement (13) or conductor wires (14). Said outer casing (16) is crimped to have the form of an open end (23) around which barbed tapes (15) longitudinally extend in an equally spaced manner along said fencing element (12) as in FIG. 2. Said outer casing (16) is further adapted to have narrowed neck portion (19) in between said cells (18, 20) to restrict movement of said reinforcement wire occupying the upper cell (18) neighboring said barbed tapes (15) toward the sensor cable (14).

Figure 6:
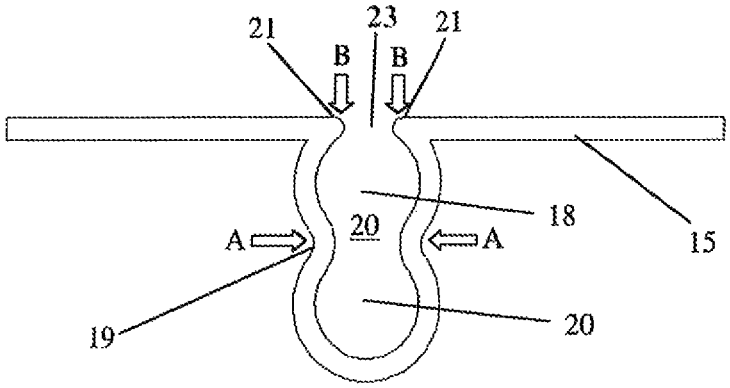
FIG. 6 demonstrates cross-sectional view of the outer casing of the tubular fencing element according to the present invention.

This is especially advantageous during the final step of the crimping process in which barbed tapes (15) are cut and transversely folded over the fencing element (12) by pressing down from the folded edge portions (21) in the direction of the arrows B as in FIG. 6. This way, while said reinforcement wire (13) is securely disposed within the outer casing (16), potential damage due to the pressure exerted by said reinforcement wire (13) on said conductor cable (14) during the final step of the crimping process is prevented.

Presence of a steel support wire (13) within the fencing element (12) substantially contributes to the mechanical strength of the fencing system. The present invention therefore eliminates manufacturing problems associated with any strengthening attempt in an effort to use more robust materials within the fencing element (12). More precisely, installing a separate steel wire (13) within the casing (16) being very much desirable up to now was only possible according to the configuration of the present invention.

The outer casing (16) according to the present invention, in the form of an eight figure with an intermediary neck portion (19) having an opening whose length being smaller than the diameters of the cells (18, 20), the latter having equal surface areas, prevents said reinforcement wire (13) from exerting pressure on the conductor wire (14) during crimping.

The crimping process according to the present invention comprises the steps of bending a sheet strip to form a lengthwise cavity (22) having an open end (19), disposing said sensor conductor (14) in said cavity (22) in a longitudinal manner, providing an intermediary neck portion (19) in said cavity (22) by applying lateral pressure in the direction of the arrows A as in FIG. 6 such that it takes the form of an eight figure comprised of two separate circular cells (18, 20), disposing said reinforcement wire (13) in the cell (18) neighboring said open end (19) and providing barbed tapes (15) in an equally spaced manner by cutting said sheet strip and folding the same transversely over the fencing element (12) by pressing from the folded edge portions (21).

Figure 3:
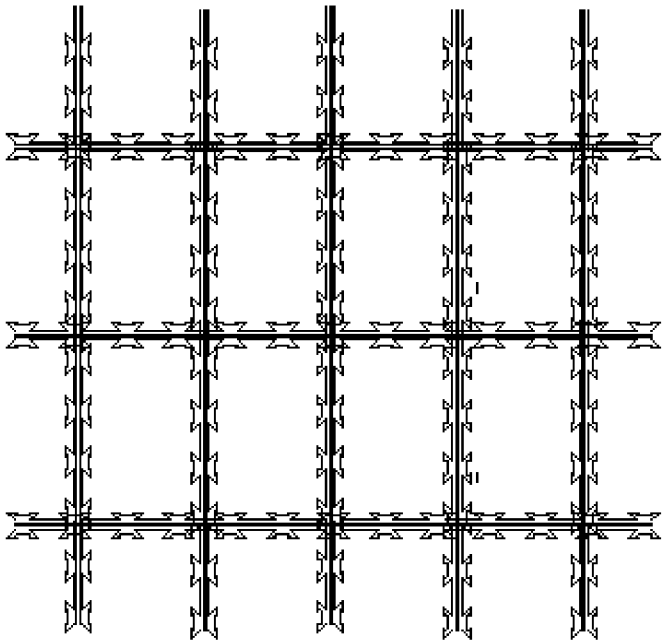
FIG. 3 demonstrates a front view of interconnected tubular elements welded to form a fence grid according to the present invention.
Figure 4:
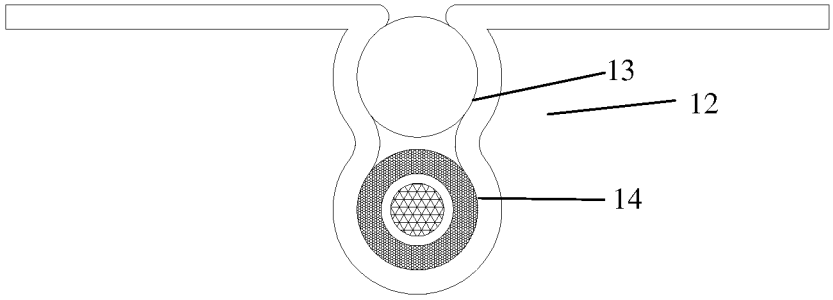
FIG. 4 demonstrates cross-sectional view of a tubular fencing element according to the present invention.
Figure 5:
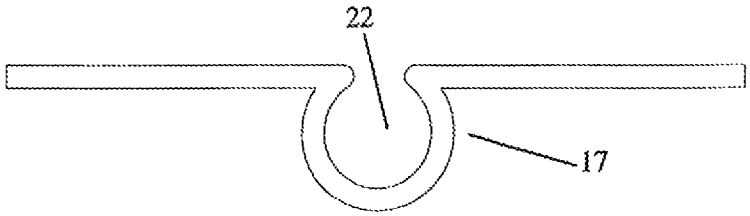
FIG. 5 demonstrates cross-sectional view of the outer casing of a conventional tubular fencing element.

The process of manufacturing a fencing system (11) having interconnected fencing elements (12) according to the present invention can be implemented in the form of helical wires as commonly referred to as concertina type as in FIG. 1 or in the form of a grid structure consisting of welded fencing elements (12) as in FIG. 3. Welding fencing elements (12) to form a grid-like structure also posed serious manufacturing problems as deformation of the sensor conductors during welding (14) is not an unlikely phenomena. To this end, said reinforcement wires (13) physically insulating said sensor conductors (14) from the welding surfaces provide an ensured manufacturing quality.

The present invention therefore provides a fencing system comprising a plurality of inter-connected tubular elements (12), each element (12) representing a certain unit length to be inter-connected. The length of a tubular element (12) may depend on manufacturing needs and may vary greatly.

In sum, the present invention proposes a fencing element (12) for forming a fencing system (11), said element (12) comprising a longitudinally extending outer casing (16) with an open end (19) around which barbed tapes (15) are provided in a longitudinally spaced manner. Said casing (16) define two cells (18, 20) respectively enclosing a reinforcement wire (13) and a sensor cable (14). Said reinforcement wire (13) and said sensor cable (14) are separated by an intermediary opening in a neck portion (19) the length of said opening being smaller than the diameters of said reinforcement wire (13) and said sensor cable (14). The length of said opening is smaller than the diameters of the cells (18, 20).

The invention claimed is:

1. A fencing element (12) for use in a fencing system (11) holding two parallel wire elements comprising:

a longitudinally extending outer casing (16) made of a bent sheet strip having opposing longitudinal edges, wherein said casing having-has a lengthwise cavity (22) having a longitudinal opening (23) disposed between opposing folded longitudinal edge portions of said bent sheet strip; and a plurality of barbed tapes (15) cut in each of the longitudinal edges of said bent sheet strip configured in a longitudinally spaced manner, wherein said bent sheet strip of said casing (16) is crimped to create a longitudinal intermediary neck portion (19) in said cavity (22) by applying pressure laterally to said sheet strip such that the cross section of said casing takes the form of a figure eight comprised of two separate longitudinal cells (18, 20) including an upper and a lower cell, said upper cell enclosing an elongated length of reinforcement wire (13) and said lower cell enclosing an elongated length of sensor cable (14), wherein said upper and lower cells (18, 20) are separated by an intermediary opening in a neck portion (19), the width of said intermediary opening and said longitudinal opening of said cavity being smaller than the diameters of said reinforcement wire (13) and said sensor cable (14).

2. The fencing element of claim 1, wherein said upper cell encloses in a coplanar configuration said reinforcement wire and said lower cell separately encloses in a coplanar configuration said sensor cable.

3. A method for manufacturing a fencing element (12) for use in a fencing system (11), said method comprising the steps of:

a) bending a sheet strip having opposing longitudinal edges to form a lengthwise cavity (22) having a longitudinal opening (23) disposed between opposing folded longitudinal edge portions of said bent sheet strip;

b) disposing a sensor conductor (14) in said cavity (22) in a longitudinal manner;

c) crimping said sheet strip to create a longitudinal intermediary neck portion (19) in said cavity (22) by applying pressure laterally to said sheet strip such that the cross section of said cavity takes the form of a figure eight comprised of two separate longitudinal cells including an upper cell (18) and a lower cell (20), and such that the previously disposed sensor conductor (14) remains longitudinally in said lower cell (20), d) disposing a reinforcement wire (13) in the upper cell (18) such that said reinforcement wire extends adjacent said neck portion (19) longitudinally along said upper cell (18);

e) providing barbed tapes (15) in a spaced manner by cutting each of the longitudinal edges of said sheet strip and folding the longitudinal edges transversely over said fencing element; and f) crimping said longitudinal opening (23) to create a partially opened longitudinal opening by applying vertical pressure on the folded edge portions such that the reinforcement wire (13) is delimited in between folded edge portions (21) and the neck portion (19) of said sheet strip.

4. The method of claim 3 for use in a fencing system (11) having interconnected fencing elements (12) formed from helical wires.

5. The method of claim 3 for use in a fencing system (11) having interconnected fencing elements (12) formed from a grid structure consisting of welded fencing elements.

* * * * *